US009814109B2

(12) United States Patent
Dhayagude et al.

(10) Patent No.: US 9,814,109 B2
(45) Date of Patent: Nov. 7, 2017

(54) APPARATUS AND TECHNIQUE FOR MODULAR ELECTRONIC DISPLAY CONTROL

(75) Inventors: Tushar Heramb Dhayagude, Santa Clara, CA (US); Dilip Sangam, Saratoga, CA (US); Hendrik Santo, San Jose, CA (US); Anjan Sen, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 1784 days.

(21) Appl. No.: 11/942,239

(22) Filed: Nov. 19, 2007

(65) Prior Publication Data

US 2009/0128053 A1 May 21, 2009

(51) Int. Cl.

| | |
|---|---|
| ***H05B 33/08*** | (2006.01) |
| ***G09G 3/20*** | (2006.01) |
| ***G09G 3/34*** | (2006.01) |

(52) U.S. Cl.

CPC ..... *H05B 33/0827* (2013.01); *G09G 3/2085* (2013.01); *G09G 3/2088* (2013.01); *G09G 3/3426* (2013.01); *H05B 33/0851* (2013.01); *G09G 2320/029* (2013.01); *G09G 2320/04* (2013.01); *G09G 2320/064* (2013.01); *G09G 2330/021* (2013.01)

(58) Field of Classification Search

CPC ..... H05B 37/02; H03K 5/00; H03K 5/01
USPC ..... 345/102, 1.1–1.9, 36, 39, 44–45, 204; 257/98, 99, 100; 315/98, 99, 100, 192, 315/169.3; 313/463
See application file for complete search history.

(56) References Cited

U.S. PATENT DOCUMENTS

| | | | | |
|---|---|---|---|---|
| 7,733,634 | B2 * | 6/2010 | Sano et al. | 361/679.02 |
| 8,049,439 | B2 * | 11/2011 | Zhao et al. | 315/297 |
| 8,115,414 | B2 * | 2/2012 | Zhao et al. | 315/299 |
| 2002/0101395 | A1 * | 8/2002 | Inukai | 345/83 |
| 2004/0135522 | A1 | 7/2004 | Berman et al. | |
| 2004/0201554 | A1 * | 10/2004 | Satoh | 345/76 |
| 2005/0088207 | A1 * | 4/2005 | Rader et al. | 327/109 |
| 2005/0231459 | A1 | 10/2005 | Furukawa | |
| 2005/0243017 | A1 * | 11/2005 | Maruyama et al. | 345/1.1 |
| 2006/0022214 | A1 * | 2/2006 | Morgan et al. | 257/99 |
| 2007/0080911 | A1 | 4/2007 | Liu | |
| 2007/0159421 | A1 | 7/2007 | Peker | |
| 2007/0171271 | A1 | 7/2007 | Wey | |

(Continued)

FOREIGN PATENT DOCUMENTS

WO WO 2007/096868 8/2007

OTHER PUBLICATIONS

International Search Report, PCT/US2008/084070, dated Jan. 26, 2009.

(Continued)

*Primary Examiner* — Shaheda Abdin
(74) *Attorney, Agent, or Firm* — Fish & Richardson P.C.

(57) ABSTRACT

The present invention discloses apparatus and techniques for modular backlighting control of a display. The display includes a number of strings of LEDs. The display is divided into several sections, and each section includes one or more strings of LEDs. A local controller is assigned to each section. The local controller receives feedback signals from the strings of LEDs in its sections and controls the drive voltages and drive currents of those strings. The local controllers communicate with each other and also with the main system controller.

17 Claims, 5 Drawing Sheets

(56) References Cited

U.S. PATENT DOCUMENTS

| | | | | |
|---|---|---|---|---|
| 2007/0229446 | A1 | 10/2007 | Oh | |
| 2007/0236447 | A1 | 10/2007 | Lee | |
| 2007/0247414 | A1 | 10/2007 | Roberts | |
| 2007/0278500 | A1* | 12/2007 | Lin | 257/81 |
| 2008/0191631 | A1* | 8/2008 | Archenhold et al. | 315/158 |

OTHER PUBLICATIONS

Supplemental European Search Report dated Dec. 16, 2010, 8 pages.
Non-Final Office Action issued in U.S. Appl. No. 13/426,301 dated Jun. 6, 2012, 20 pages.

* cited by examiner

APPARATUS AND TECHNIQUE FOR MODULAR ELECTRONIC DISPLAY CONTROL

FIELD OF INVENTION

The present invention relates to displays that use light emitting diodes (LEDs) for backlighting. Specifically, the present invention discloses a modular control architecture, in which the LEDs are divided into several sections and different local controllers are assigned to control the different sections.

BACKGROUND OF THE INVENTION

Referring to FIG. 1, the display 100 is shown including pixel circuitry 104 and backlighting circuitry 106. The display 100 can include a liquid crystal display. The pixel circuitry 104 includes a large number of pixels, for example, two million pixels, arranged in a matrix of rows and columns. The pixel matrix is driven by pixel drivers. The system controller 102 controls the pixels by way of the pixel drivers. The system controller 102 selects the pixel that is to be illuminated and also provides the image data to that pixel, by way of the pixel drivers.

The system controller 102 also controls the backlighting circuitry 106. The backlighting circuitry 106 provides the backlight in the displays. In many displays, the backlight is provided by one or more cold cathode fluorescent lamps (CCFL). Recently however, display manufacturers are trying to use light emitting diodes (LEDs) for providing the backlight in the displays. The LEDs are generally arranged in multiple strings. Each string contains several LEDs coupled to each other in a series configuration.

The LED strings can be arranged in a number of different configurations. One such configuration is a parallel configuration, as shown in FIG. 2(*a*). In FIG. 2(*a*), the LEDs 202 are arranged in the parallel LED strings 204. One end of each of the LED strings 204 is coupled to the drive voltage source 206. The other end of each of the LED strings 204 is coupled to the ground. Another configuration is a crisscross type configuration in which the various LED strings 208 seem intertwined, as shown in FIG. 2(*b*). The LED strings 204, 208 emit light when currents flow through them, thereby providing the backlight. The current flowing through each LED 202 of a LED string 204 or 208 is the same because the LEDs of the string are coupled in the series configuration.

The current flowing through a LED string 204 or 208 is known as the drive current of the LED 202. The drive current of the LED 202 is typically generated by applying a voltage to one end of the LED string 204 or 208 and coupling the other end of the LED string 204 or 208 to the ground. The voltage applied to the LED string 204 or 208 is known as the drive voltage of the LED string 204 or 208. The drive voltages and the drive currents of the LED strings 204 or 208 are generally managed by a system controller of the device housing the display, for example, the system controller of a television set.

FIG. 3 shows a prior art display 300 including a drive voltage source 302, LED strings 304, 306, 308, 310, 312, 314, 316, 318 and the system controller 340. The LED strings 304, 306, 308, 310, 312, 314, 316 and 318 are coupled to the field effect transistors (FETs) 320, 322, 324, 326, 328, 330, 332 and 334 respectively. The voltage source 302 is coupled at a common node to one end of each LED string 304, 306, 308, 310, 312, 314, 316 and 318. The voltage source 302 provides the same drive voltage to all the LED strings 304, 306, 308, 310, 312, 314, 316 and 318. The voltage source 302 interfaces with the system controller 340. The system controller 340 also interfaces with the FETs 320, 322, 324, 326, 328, 330, 332 and 334.

The system controller 340 controls the level of the drive voltage by way of the voltage source 302. The system controller 340 is also coupled to the gates (G) of the FETs 320, 322, 324, 326, 328, 330, 332 and 334. The system controller 340 selectively couples the LED strings 304, 306, 308, 310, 312, 314, 316 and 318 to the ground by selectively providing gate voltages to the FETs 320, 322, 324, 326, 328, 330, 332 and 334, thereby creating an electrical path between the voltage source 302 and the ground and allowing the drive currents to flow through the LED strings 304, 306, 308, 310, 312, 314, 316 and 318.

Generally, the system controller 340 controls all aspects of the device housing the display, for example, a television set. The system controller 340 of a television set is a sophisticated device that generally includes a high speed central processing unit (CPU) for multitasking and controlling the overall system functions including power management, analog to digital to analog signal conversion, controlling the row and the column drivers for the pixel circuitry, controlling the backlighting circuitry, and interfacing with the receiver that receives the video and audio feed for the various channels. The system controller 340 carries an enormous amount of work load and requires a large amount of memory and a high speed CPU to do the multitasking of that workload. It would desirable to reduce the workload of the system controller 340 and to perform several tasks in parallel in time with the system controller 340. That would provide for a better and flexible display system that requires less memory and processor speed and can be available for performing new tasks.

SUMMARY OF THE INVENTION

The present invention discloses apparatus and techniques for controlling the LED strings that form the backlight of a liquid crystal display. The display is divided into several sections and each section is assigned with a local controller. A local controller controls the LED strings that are inside the section assigned to it. The local controller receives feedback signals from the LED strings in its section and uses that feedback to select the lead string and to set the drive voltages and currents for those LED strings. The local controller is an application specific integrated circuit. Each LED string is coupled to a field effect transistor (FET). The FETs can be located inside the local controller or outside the local controller. The FETs provide the local controller with feedback signals indicative of the currents flowing through the LED strings. The local controller selectively provides voltages to the gates of the FETs to selectively turn on the FETs. The timing, duty and phase information for selectively providing the voltages to the gates of the FETs can be provided by the system controller to the local controller. An LED string provides an electrical path for the current to flow through it only when its FET is turned on. The local controllers of the display communicate with each other and share information about their respective LED strings with each other. The local controllers also communicate with the system controller of the display and receive synchronization signals from the system controller, to ensure that the local controllers and the system controller are synchronized with each other.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

The present invention provides a modular approach to controlling the backlight LEDs. The present invention discloses an application specific integrated circuit (ASIC) that can perform the backlight control function. The ASIC of the present invention is a local controller that can be used for backlighting control in displays of applications such as LCD TVs, signage, scrolling LCD surfaces, general lighting, LED backdrops in stadiums, concerts, decorations and the like. The apparatus and techniques of the present invention are applicable to display devices of wide ranging sizes and power ratings. For example, the apparatus and techniques of the present invention can be applied to LEDs ranging from a low power LED that dissipates 40 milli-watts (mW) of power to a high power LED that dissipates 5 watts (W) of power.

According to one aspect of the present invention, the LEDs of a display are divided into several sections and a separate ASIC of the present invention is assigned to control each section. According to another aspect of the present invention, the ASICs of the present invention interact with the system controller and share the workload of the system controller. According to another aspect of the present invention, the ASIC receives a synchronization signal from the system controller to synchronize the operation of the ASIC with the system controller. According to another aspect of the present invention, the local controllers communicate with each other and share information about the LED strings under their control.

According to another aspect of the present invention, the ASIC of the present invention receives feedback signals from the section of the LED strings that it is assigned to control, and uses those feedback signals to select the lead string and to control the drive voltages and currents of those LED strings. According to another aspect of the present invention, the field effect transistors (FETs) that are used to selectively turn on and turn off the LED strings are situated on the ASIC. According to another aspect of the present invention, those FETs are situated outside the ASIC and are coupled to the ASIC. In another aspect of the present invention, the timing, duty and phase information for controlling the FETs can be provided by the system controller to the local controller. According to another aspect of the present invention, the ASIC of the present invention can be used with both isolated power topologies, such as Forward and Flyback converters, and with non-isolated topologies, such as Buck, Boost and derived topologies.

Figure 1:
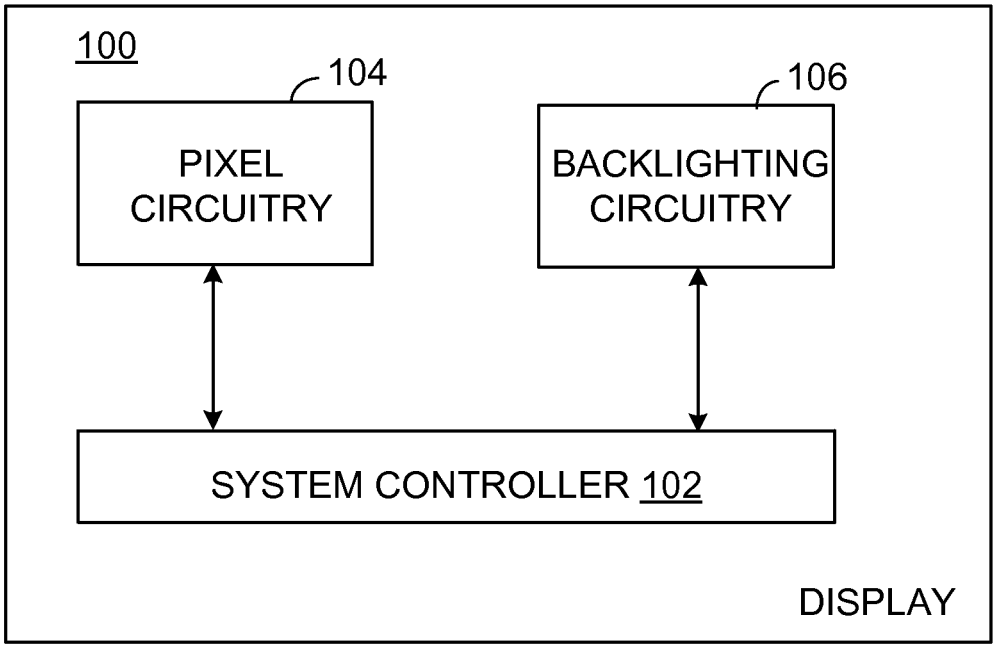
(PRIOR ART) FIG. 1
FIG. 1 illustrates a high level functional block diagram of a display.
Figure 2A:
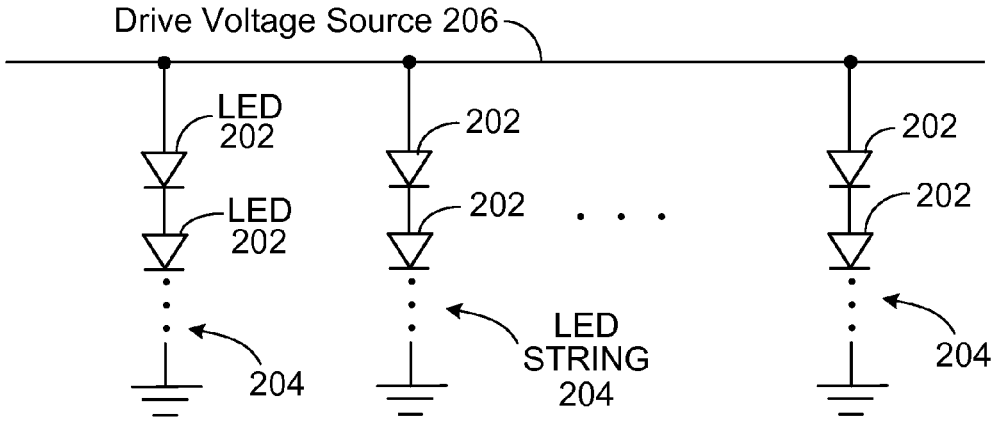
(PRIOR ART) FIG. 2A
FIGS. 2(*a*) and 2(*b*) illustrate exemplary alternative LED strings arrangements for a display.
Figure 2B:
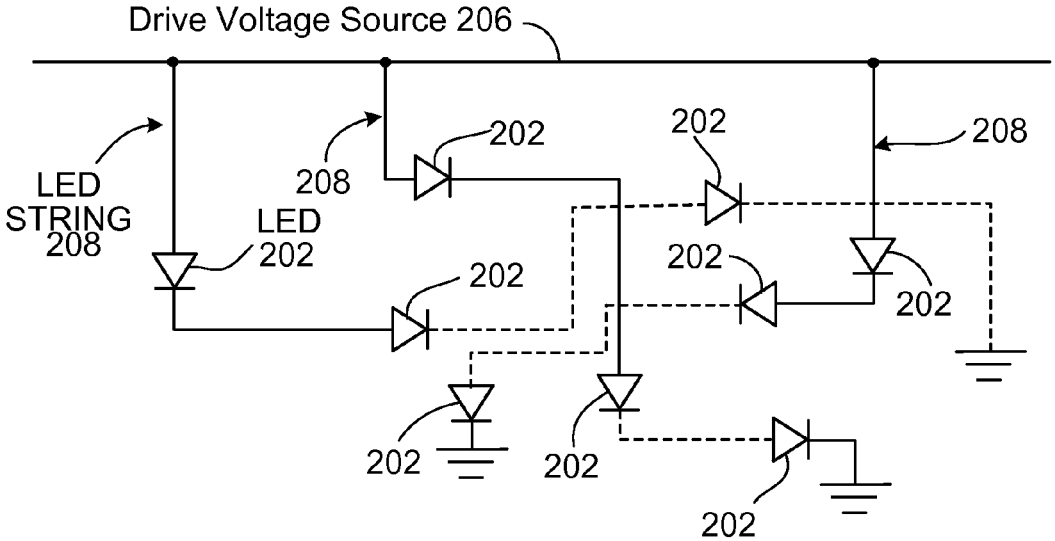
(PRIOR ART) FIG. 2B
Figure 3:
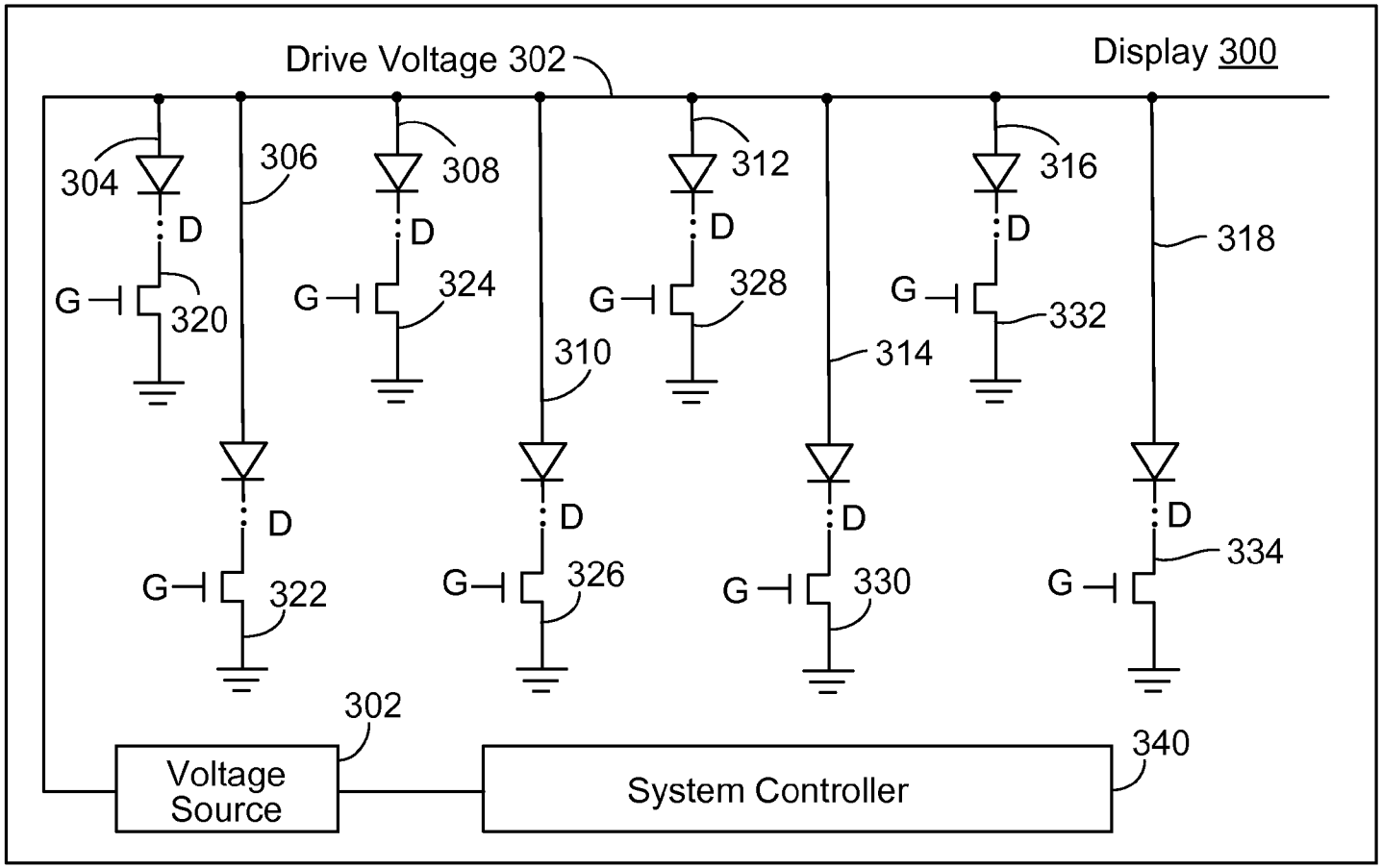
(PRIOR ART) FIG. 3
FIG. 3 illustrates the functional block diagram for the prior art backlighting system for a display.
Figure 4:
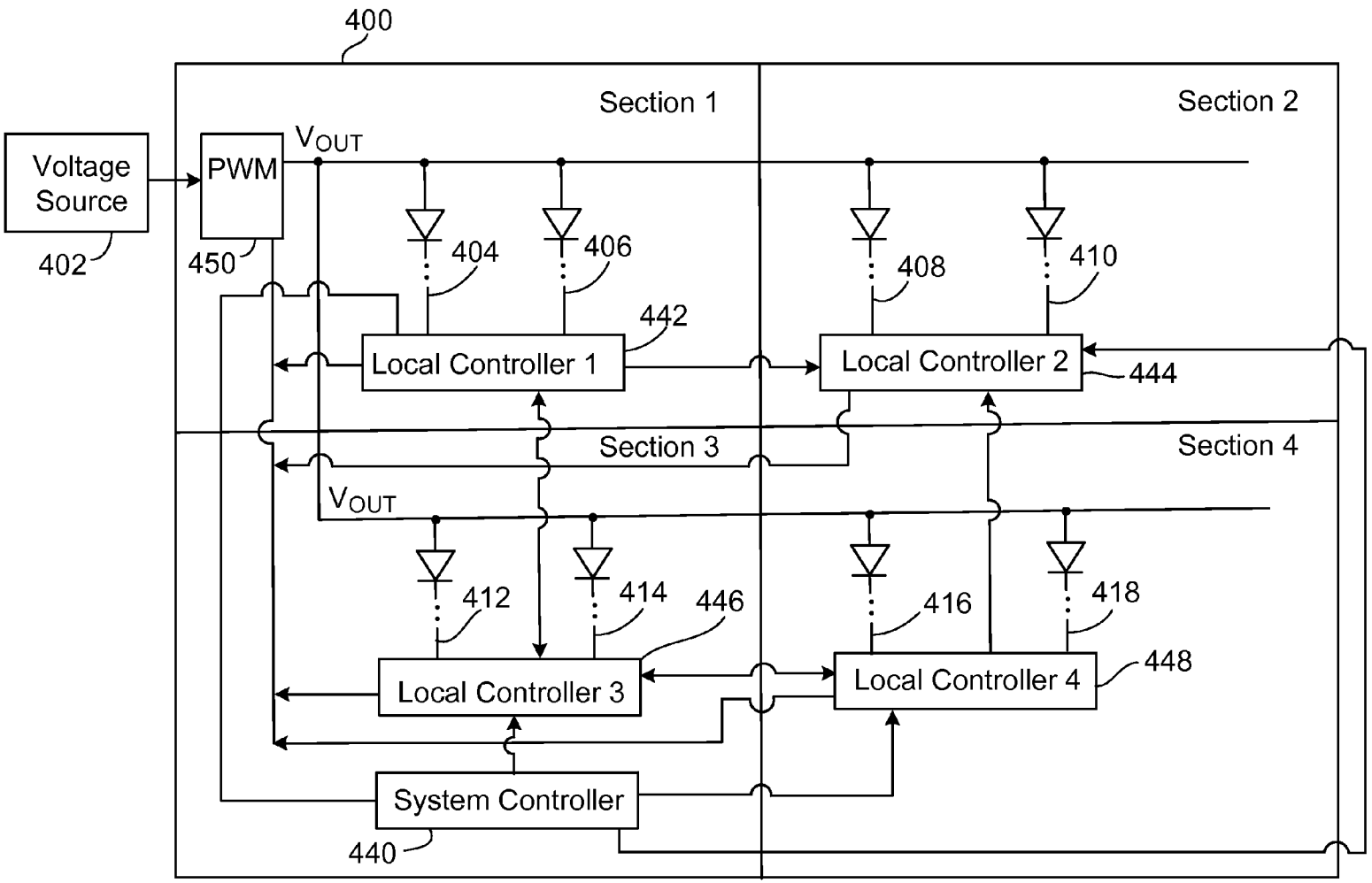
FIG. 4 illustrates the functional block diagram for an exemplary backlighting system of the present invention.

FIG. 4 illustrates an exemplary functional block diagram of the system of the present invention. The display 400 is shown including eight strings of LEDs 404, 406, 408, 410, 412, 414, 416 and 418. The voltage source 402 feeds power to the Power Converter/Regulator 450. The voltage source 402 can be an AC-DC controller or a DC to DC controller. The Power Converter/Regulator 450 can have an isolated topology, such as Forward or Flyback converter, or a non-isolated topology, such as Buck, Boost or derived converter topology. The voltage source 402 can provide the Power Converter 450 with an off-line DC supply or Battery Power. The output of the PWM controller 450 is the drive voltage (Vout) that drives the LED strings 404-418. The PWM controller can be programmable to provide the drive voltage (Vout) of selected pulse widths. The pulse widths can be selected based on the desired instantaneous, average or total drive voltage (Vout).

In the exemplary embodiment of FIG. 4, the display 400 is divided into four. One of ordinary skill in the art will appreciate that the display can be divided into various other numbers for sections. Each section is assigned a local controller (LC) 442, 444, 446 or 448 for controlling the LED strings in that section. The local controller (LC) 442, 444, 446 or 448 is an intelligent controller that accepts and processes the system signals. For example, in a TV system, the LC 442, 444, 446 or 228 will accept a horizontal synchronization (HSYNC) and vertical synchronization (VSYNC) signals from the timing controller. LC1 442 controls the LED strings 404 and 406 of section 1. LC2 444 controls the LED strings 408 and 410 of section 2. LC3 446 controls the LED strings 412 and 414 of section 3. LC4 448 controls the LED strings 416 and 418 of section 4. The system controller 440 is shown coupled to the local controllers LC1-LC4 442, 444, 446 and 448. The local controllers LC1-LC4 442, 444, 446 and 448 are also coupled to each other.

The PWM controller 450 is shown coupled to one end of each of the LED strings 404-418 at a common node. The LED strings 404-418 are coupled to the ground by way of the field effect transistors (FETs) (not shown). In one embodiment, the FETs are located inside the local controllers LC1-LC4 442, 444, 446 and 448. In another embodiment, the FETs are located outside the local controllers LC1-LC4 442, 444, 446 and 448. The drains, the sources and the gates of the FETs coupled to the LED strings 404 and 406 are coupled to the LC1 442. Similarly, the drains, the sources and the gates of the FETs coupled to the LED strings 408 and 410 are coupled to the LC2 444. LC1 442 can selectively drive the gates of the FETs of the LED strings 404 and 406. LC1 442 receives feedback signals from the drains and/or the sources of the FETs of the LED strings 404 and 406. Similarly, LC2 444 can selectively drive the gates of the FETs of the LED strings 408 and 410. The LC2 444 can receive feedback signals from the drains and/or the sources of the FETs of the LED strings 408 and 410.

The LC1 442 can use the feedback signals to determine the lead string in section 1. The lead string is the string that has the highest forward voltage and therefore requires the highest drive voltage level (Vout) to generate the desired current (i.e. the desired luminance). The drive voltage level of the LED strings of section 1 must be at or above the minimum drive voltage level (Vout) required to cause the lead string to generate the desired current. In the embodiment of FIG. 4, the lead string for section 1 will be selected from either the LED string 404 or the LED string 406. However, one of ordinary skill in the art will appreciate that section 1 may contain many more LED strings than just two. One of ordinary skill in the art will appreciate that a LED string may contain various numbers of LEDs. Additionally, in one embodiment, each local controller (LC) 442, 444, 446 and 448 can drive LED strings of different colors. In that embodiment, multiple Power Converters/Regulators 450 can be used for powering the LED strings of different colors. For example, one Power Converter/Regulator 450 can power the red LED strings and another Power Converter/regulator 450 can power the blue LED strings.

The four local controllers LC1-LC4 442, 444, 446 and 448 are coupled to the Power Converter/Regulator 450 and can control the level of the drive voltage (Vout) provided by that Power Converter/Regulator 450 to the LED strings 404-418. In one embodiment, the LEDs of the four sections are illuminated sequentially and therefore lead string of a section is used to determine the drive voltage level (Vout) during the illumination period for that section. In another embodiment, the local controllers LC1-LC4 442, 444, 446 and 448 share information about their respective lead strings to determine which lead string has the highest forward voltage. In that embodiment, the lead string having the highest forward voltage is used to set the drive voltage (Vout) level. One of ordinary skill in the art will appreciate that the physical characteristics of the LED strings frequently change and therefore the lead string may change from time to time. Therefore, the local controllers LC1-LC4 442, 444, 446 and 448 are configured to periodically determine the lead strings in their respective sections.

By controlling the drive voltage level (Vout) provided to the LED strings 404 and 406, and by controlling the on times of the FETs coupled to the LED strings 404 and 406, the LC1 442 can control the drive currents of the LED strings 404 and 406. Similarly, by controlling the drive voltage (Vout) provided to the LED strings 408 and 410, and by controlling the on times of the FETs coupled to the LED strings 408 and 410, the LC2 444 control the drive currents of the LED strings 408 and 410. One of ordinary skill in the art will appreciate that the LC1 442 and the LC2 444 can perform their control functionalities simultaneously and independently of each other.

The controllers LC1-LC4 442, 444, 446 and 448 are shown coupled to the system controller 440. The system controller 440 is responsible for the overall management of the television set or the computer system. The system controller 440 controls the timing of the display 400. In one embodiment, the display 400 is updated with still images at the rate of at least thirty frames per second to form moving images by virtue of persistence of vision in human eyes. Each frame includes several scan lines and each scan line includes several pixels. Image signals received by the display drivers from the system controller 440 of the display include data corresponding to a series of pixels. In order to ensure that the display drivers can locate the position corresponding to each pixel data, aside from the pixel data, the system controller will further provide to the display apparatus a horizontal synchronization (HSYNC) signal to indicate the start of a scan line, and a vertical synchronization (VSYNC) signal to indicate the start of a frame.

In one embodiment of the present invention, the system controller 440 provides the local controllers LC1-LC4 with the synchronization signals HSYNC and VSYNC, such that the LC1-LC4 442, 444, 446 and 448 can use those signals to synchronize the backlighting control with the pixel circuitry control. In other word, the local controllers LC1-LC4 442, 444, 446 and 448 can use the synchronization signals received from the system controller 440 to determine the pixel that is displaying the image at a given time and provide the proper backlight adjustments for the section corresponding to that pixel. In another embodiment of the present invention, the system controller 440 provides the local controllers LC1-LC4 442, 444, 446 and 448 with the timing, the phase and the duty cycle information for driving the respective FETs of the LED strings 404-418. The timing, the phase and the duty cycle information is determined by the system controller 440 depending on the luminance, color and other attributes of the image to be displayed.

In an alternate exemplary embodiment of the present invention, the local controllers are assigned to according to the colors of the LEDs instead of by the sections of the display. Specifically, the LC1 442 controls the LEDs that are used to generate on the red light, the LC2 444 controls the LEDs that are used to generate the blue light, the LC3 446 controls the LEDs that are used to generate the white light, and the LC4 448 controls the LEDs that the used to generate the green light. One of ordinary skill in the art will appreciate that various such arrangements are possible, depending on the needs of a particular system design.

Figure 5:
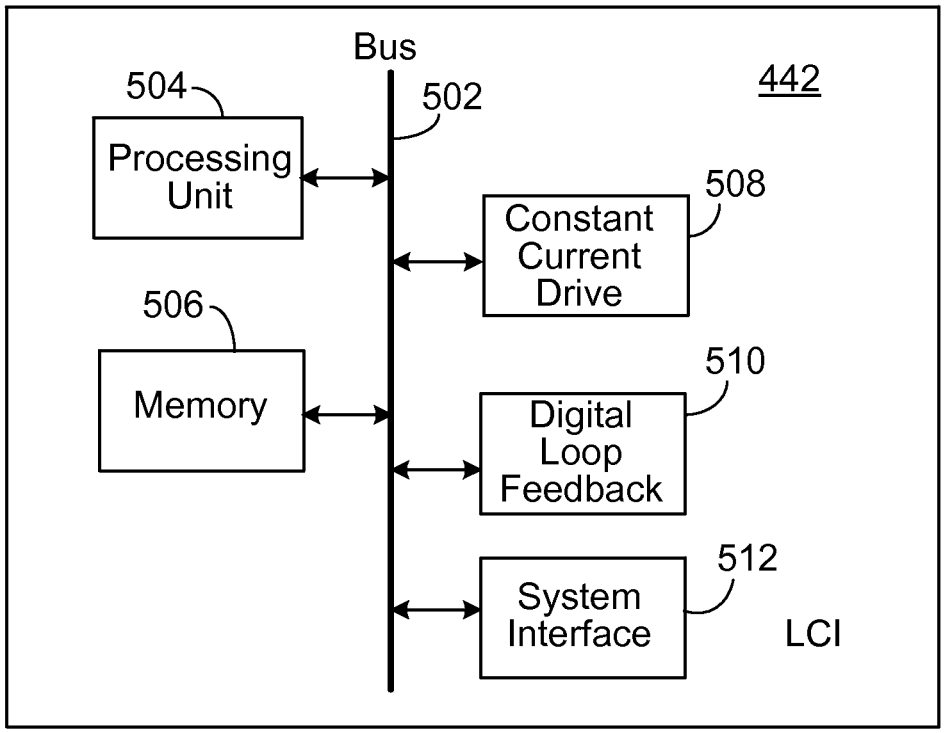
FIG. 5 illustrates the functional block diagram for an exemplary local controller of the present invention.

FIG. 5 illustrates a functional block diagram of an exemplary local controller 1 (LC1) 442 of the present invention. The LC1 can be implemented in hardware or firmware. The components of the LC1 include the processing unit 504, the memory 506, the constant current drive module 508, the digital loop feedback module 510 and the system interface module 512. The units of the LC1 are interconnected by the bus 502. The processing unit 504 can be a general purpose or a special purpose microprocessor that can be used to process data. The memory 506 can be used to temporarily store data during processing. The memory 506 can also be used to store the program(s) for controlling the operation of the LC1. In one embodiment, the constant current drive module 508 can include the FETs coupled to the LED strings 404 and 406. In another embodiment, the FETs coupled to the LED strings 404 and 406 are external to the LC1 but are coupled to the constant current drive module 508.

The constant current drive module 508 controls the current flowing through the LED strings 404 and 406 by selectively providing voltages to the gates of the FETs coupled to the LED strings 404 and 406. The current drive module 508 pulses the gates of those FETs depending on the desired color and luminance. The pulsing of the gates is done by using pulse width modulation (PWM) signals, which are generated internal to the LC1 thereby greatly reducing the noise generated by the system. The system interface module 512 interfaces with the system controller 440 and the other local controllers LC2-LC4. The system interface module 512 receives configuration information from the system controller 440 as well as the timing, phase and duty information for generating the PWM signals for the selectively pulsing of the gates of the FETs coupled to the LED strings 404 and 406. The constant current drive module 508 can also be used to determine the lead string.

The digital loop feedback module 510 interfaces with the PWM controller 450 and can be used to set the drive voltage level (Vout) depending on the lead string and the desired drive currents for the LED strings 404 and 406. The LC1 442 can periodically determine if the LED string 404 or the LED string 406 is the lead string and adaptively adjust the drive voltage level (Vout) accordingly. In one embodiment the local controllers LC1-LC4 442, 444, 446 and 448 are structurally and functionally identical. In one embodiment, the local controllers LC1-LC4 442, 444, 446 and 448 are structurally the same but are programmed differently to perform some of the functions differently.

One of ordinary skill in the art will appreciate that the techniques, structures and methods of the present invention above are exemplary. The present invention can be implemented in various embodiments without deviating from the scope of the invention.

The invention claimed is:

1. A display comprising:

light emitting diodes (LEDs) arranged in a plurality of LED strings, wherein each LED string includes a plurality of LEDs, the plurality of LED strings divided among a plurality of sections of the display;

a system controller configured for controlling a timing of the display; and a different local controller assigned to each section of the display and configured for controlling LED strings in the section of the display by:

receiving feedback signals from the plurality of LED strings included in the section;

based on receiving the feedback signals, selecting a lead string for the section from the plurality of LED strings, the lead string being a LED string with a forward voltage that is greater than forward voltages of other LED strings in the section;

determining a current flowing through the lead string for the section;

in response to determining the current flowing through the lead string, determining a drive voltage to be provided to the lead string to generate a target current in the lead string; and providing the determined drive voltage to the plurality of LED strings in the section, wherein a reference signal from the system controller is utilized for synchronizing operation of the local controller with the system controller.

2. The display of claim 1, wherein the display is a liquid crystal display.

3. The display of claim 1, wherein the local controller includes an application specific integrated circuit (ASIC).

4. The display of claim 1, wherein the local controller includes a microprocessor.

5. The display of claim 1, wherein the local controller includes a memory.

6. The display of claim 1, wherein the local controller assigned to a particular section is configured to adjust a drive voltage that is provided to LED strings in the particular section of the display controlled by the local controller.

7. The display of claim 1, wherein a LED string is coupled to ground by way of a field effect transistor (FET).

8. The display of claim 7, wherein the FET is incorporated inside the local controller of the section that includes the LED string coupled to the FET.

9. The display of claim 7, wherein the local controller for a particular section receives a feedback signal from the FET attached to a particular LED string included in the particular section, wherein the feedback signal provides information associated with a current flowing through the particular LED string.

10. The display of claim 1, wherein the local controller for a particular section periodically selects the lead string from the plurality of LED strings included in the particular section.

11. The display of claim 10, wherein the local controller for the particular section periodically adjusts the drive voltage that is provided to the LED strings in the particular section controlled by the local controller based upon the current flowing through the lead string.

12. The display of claim 1, wherein the local controller assigned to a section shares information with local controllers assigned to other sections for determining a lead string from the plurality of LED strings across the plurality of sections of the display.

13. A method for a display comprising:

dividing the display into a plurality of sections;

assigning a different local controller for each section of the plurality of sections;

providing feedback signals indicative of current flowing through light emitting diode (LED) strings included in a particular section of the display to a local controller assigned to the particular section, wherein a LED string includes a plurality of LEDs;

periodically selecting a lead string for the particular section from the LED strings included in the particular section based upon the feedback signals, the lead string being a LED string with a forward voltage that is greater than forward voltages of other LED strings in the particular section;

determining a current flowing through the lead string for the particular section;

in response to determining the current flowing through the lead string, determining a drive voltage to be provided to the lead string to generate a target current in the lead string;

providing the determined drive voltage to the plurality of LED strings included in the particular section; and providing a reference signal to the local controllers from a system controller of the display to synchronize operation of the local controllers with the system controller.

14. A local controller for a display comprising:

a processing unit;

a machine-readable non-transitory memory location;

a first module including instructions stored in the memory location and executable by the processing unit, the instructions configured to cause the processing unit to perform operations including:

receiving a reference signal from a system controller, wherein the reference signal enables synchronizing the operation of the local controller with the system controller;

receiving configuration information from the system controller; and receiving information for providing a voltage to a plurality of field effect transistors (FETs) attached to a plurality of LED strings that are included in a section of the display controlled by the local controller, wherein each LED string includes a plurality of LEDs;

a second module including instructions stored in the memory location and executable by the processing unit, the instructions configured to cause the processing unit to perform operations including:

receiving feedback signals from the plurality of FETs attached to the plurality of LED strings in the section of the display controlled by the local controller, wherein the feedback signals provide information associated with currents flowing through the plurality of LED strings in the section of the display controlled by the local controller;

determining a lead string of from the plurality of LED strings that are included in the section of the display controlled by the local controller based upon the feedback signals, the lead string being a LED string with a forward voltage that is greater than forward voltages of other LED strings in the section; and providing a voltage to the plurality of FETs attached to the plurality of LED strings in the section of the display controlled by the local controller, wherein the voltage is generated internal to the local controller; and a third module including instructions stored in the memory location and executable by the processing unit, the instructions configured to cause the processing unit to perform operations including:

determining a current flowing through the lead string;

in response to determining the current flowing through the lead string, determining a drive voltage to be provided to the lead string to generate a target current in the lead string; and providing the determined drive voltage to the LED strings in the section of the display controlled by the local controller.

15. The local controller of claim 14, wherein the local controller includes an application specific integrated circuit (ASIC).

16. The local controller of claim 15, wherein the plurality of FETs are located inside the ASIC.

17. The local controller of claim 14, wherein the display comprises:

a plurality of local controllers, wherein each local controller controls light emitting diodes of a different section of the display.

* * * * *